US009168714B2

(12) United States Patent
Fike et al.

(10) Patent No.: US 9,168,714 B2
(45) Date of Patent: Oct. 27, 2015

(54) METHODS FOR MAKING PAPERBOARD BLANKS AND PAPERBOARD PRODUCTS THEREFROM

(75) Inventors: Gregory M. Fike, Atlanta, GA (US); Andrew J. Fojtik, Appleton, WI (US); Kristopher A. Kules, Oshkosh, WI (US); Joseph R. Pounder, Greenville, WI (US); Michael A. Breining, Neenah, WI (US)

(73) Assignee: DIXIE CONSUMER PRODUCTS LLC, Atlanta, GA (US)

( * ) Notice: Subject to any disclaimer, the term of this patent is extended or adjusted under 35 U.S.C. 154(b) by 722 days.

(21) Appl. No.: 13/538,085

(22) Filed: Jun. 29, 2012

(65) Prior Publication Data

US 2012/0312869 A1 Dec. 13, 2012

Related U.S. Application Data

(60) Continuation-in-part of application No. 12/909,617, filed on Oct. 21, 2010, now Pat. No. 8,622,232, which is a continuation-in-part of application No. 12/380,314, filed on Feb. 26, 2009, now Pat. No.

(Continued)

(51) Int. Cl.
*B31B 1/00* (2006.01)
*B65D 81/38* (2006.01)

(52) U.S. Cl.
CPC ..... *B31B 1/00* (2013.01); *B65D 81/3869* (2013.01); *B31B 2217/0084* (2013.01); *B31B 2217/062* (2013.01); *B31B 2217/064* (2013.01); *B31B 2217/082* (2013.01)

(58) Field of Classification Search
CPC ..... B65D 1/28; B65D 1/265; B65D 1/26; B65D 25/18; B65D 25/16; B65D 25/14; B65D 81/3874; B65D 81/3869; B65D 81/3865; B65D 81/263; B65D 5/4295; B32B 15/08; B32B 15/04; B32B 27/10; A47G 19/2255; A47G 19/2205; A47G 19/2288; B31B 1/00
USPC ..... 220/62.22, 495.05, 495.04, 745, 220/592.17, 592.16, 62, 62.12; 229/403, 229/400; 428/34.2, 34.3, 35.8, 35.7
See application file for complete search history.

(56) References Cited

U.S. PATENT DOCUMENTS 593,316 A 11/1897 Woodman
1,157,008 A 10/1915 Lang (Continued)

FOREIGN PATENT DOCUMENTS

JP 57-065158 A 4/1982
JP 06-219474 8/1994

(Continued)

OTHER PUBLICATIONS

Williams, Mark B. et al. "Investigation of Spatial Resolution and Efficiency Using Pinholes with Small Pinhole Angle". Nuclear Science Symposium Conference Record, 2002 IEEE. Nov. 10-16, 2002, p. 1760-1764 vol. 3.

(Continued)

*Primary Examiner* — Robert J Hicks
(74) *Attorney, Agent, or Firm* — William W. Letson

(57) ABSTRACT

Methods for making paperboard blanks and paperboard products therefrom are provided. In one aspect, a method for making a paperboard blank can include burning a paperboard substrate to form at least one aperture therethrough. The method can also include securing a film onto a first side of the paperboard substrate to produce a paperboard blank.

26 Claims, 3 Drawing Sheets

Related U.S. Application Data

7,841,974, which is a division of application No. 11/478,075, filed on Jun. 29, 2006, now Pat. No. 7,510,098, which is a continuation-in-part of application No. 11/174,434, filed on Jun. 30, 2005, now Pat. No. 7,513,386.

(56) References Cited

U.S. PATENT DOCUMENTS

| | | | |
|---|---|---|---|
| 1,407,688 | A | 2/1922 | Banton |
| 1,756,243 | A | 4/1930 | Benson |
| 1,944,042 | A | 1/1934 | Thompson |
| 2,266,828 | A | 12/1941 | Sykes |
| 2,563,352 | A | 8/1951 | Morse |
| 2,678,764 | A | 5/1954 | Carlson |
| 2,853,222 | A | 9/1958 | Gallagher |
| 2,961,849 | A | 11/1960 | Hitchcock |
| 3,082,900 | A | 3/1963 | Goodman |
| 3,134,307 | A | 5/1964 | Loeser |
| 3,203,611 | A | 8/1965 | Anderson et al. |
| 3,237,834 | A | 3/1966 | Davis et al. |
| 3,246,745 | A | 4/1966 | Stocker, Jr. |
| 3,354,021 | A | 11/1967 | Royet |
| 3,402,874 | A | 9/1968 | Sternall |
| 3,406,814 | A | 10/1968 | Gulliver |
| 3,627,166 | A | 12/1971 | Walter |
| 3,669,337 | A | 6/1972 | Struble |
| 3,737,093 | A | 6/1973 | Amberg et al. |
| 3,781,183 | A | 12/1973 | Doll |
| 3,854,583 | A | 12/1974 | Amberg et al. |
| 3,988,521 | A | 10/1976 | Fumel et al. |
| 3,995,740 | A | 12/1976 | Amberg et al. |
| 4,051,951 | A | 10/1977 | Smith |
| 4,087,003 | A | 5/1978 | Adamek |
| 4,194,039 | A | 3/1980 | Mueller |
| 4,197,948 | A | 4/1980 | Amberg et al. |
| 4,261,501 | A | 4/1981 | Watkins et al. |
| 4,332,635 | A | 6/1982 | Holbrook et al. |
| 4,359,160 | A | 11/1982 | Myers et al. |
| 4,383,422 | A | 5/1983 | Gordon et al. |
| 4,398,904 | A | 8/1983 | Fagerberg |
| 4,435,344 | A | 3/1984 | Iloka |
| 4,452,596 | A | 6/1984 | Clauss et al. |
| 4,459,793 | A | 7/1984 | Zenger |
| 4,486,366 | A | 12/1984 | Reddy |
| 4,514,354 | A | 4/1985 | Schlesinger et al. |
| 4,551,366 | A | 11/1985 | Maruhashi et al. |
| 4,679,724 | A | 7/1987 | Inagaki |
| 4,692,132 | A | 9/1987 | Ikushima et al. |
| 4,923,557 | A | 5/1990 | Dickey |
| 4,952,451 | A | 8/1990 | Mueller |
| 4,971,845 | A | 11/1990 | Aaker et al. |
| 4,982,872 | A | 1/1991 | Avery |
| 4,985,300 | A | 1/1991 | Huang |
| 5,001,016 | A | 3/1991 | Kondo et al. |
| 5,063,005 | A | 11/1991 | Doheny, Jr. |
| 5,092,485 | A | 3/1992 | Lee |
| 5,145,107 | A | 9/1992 | Silver et al. |
| 5,205,473 | A | 4/1993 | Coffin, Sr. |
| 5,217,307 | A | 6/1993 | McClintock |
| 5,279,872 | A | 1/1994 | Ralph |
| 5,460,323 | A | 10/1995 | Titus |
| 5,469,983 | A | 11/1995 | Yawata |
| 5,490,631 | A | 2/1996 | Iioka |
| 5,691,049 | A | 11/1997 | Morita et al. |
| 5,700,689 | A | 12/1997 | Wuster |
| 5,707,751 | A | 1/1998 | Garza et al. |
| 5,725,916 | A | 3/1998 | Ishii et al. |
| 5,736,231 | A | 4/1998 | Todt |
| 5,766,709 | A | 6/1998 | Geddes et al. |
| 5,840,139 | A | 11/1998 | Geddes et al. |
| 5,851,610 | A | 12/1998 | Ristey et al. |
| 5,882,612 | A | 3/1999 | Riley |
| 5,952,068 | A | 9/1999 | Neale et al. |
| 5,954,217 | A | 9/1999 | Brkovic et al. |
| 5,993,705 | A | 11/1999 | Grishchenko et al. |
| 6,030,476 | A | 2/2000 | Geddes et al. |
| 6,085,970 | A | 7/2000 | Sadlier |
| 6,098,829 | A | 8/2000 | McHenry et al. |
| 6,129,653 | A | 10/2000 | Fredricks et al. |
| 6,139,665 | A | 10/2000 | Schmelzer et al. |
| 6,142,331 | A | 11/2000 | Breining et al. |
| 6,152,363 | A | 11/2000 | Rule, Jr. |
| 6,224,954 | B1 | 5/2001 | Mitchell et al. |
| 6,364,149 | B1 | 4/2002 | Smith |
| 6,536,657 | B2 | 3/2003 | Van Handel |
| 6,723,446 | B2 | 4/2004 | Seta et al. |
| 6,729,534 | B2 | 5/2004 | Van Handel |
| 6,739,470 | B2 | 5/2004 | Yawata |
| 6,852,381 | B2 | 2/2005 | Debraal et al. |
| 6,872,462 | B2 | 3/2005 | Roberts et al. |
| 6,908,687 | B2 | 6/2005 | Mendes et al. |
| 7,281,650 | B1 | 10/2007 | Milan |
| 7,464,856 | B2 | 12/2008 | Van Handel |
| 7,464,857 | B2 | 12/2008 | Van Handel |
| 7,510,098 | B2 | 3/2009 | Hartjes et al. |
| 7,513,386 | B2 | 4/2009 | Hartjes et al. |
| 7,600,669 | B2 | 10/2009 | Van Handel |
| 7,841,974 | B2 | 11/2010 | Hartjes et al. |
| 7,913,873 | B2 | 3/2011 | Van Handel |
| 7,938,313 | B1 | 5/2011 | Van Handel |
| 8,286,824 | B2 | 10/2012 | Ikeda et al. |
| 2003/0015582 | A1 | 1/2003 | Van Handel |
| 2003/0021921 | A1 | 1/2003 | Debraal et al. |
| 2003/0121963 | A1 | 7/2003 | Van Handel |
| 2004/0170814 | A1 | 9/2004 | Van Handel |
| 2005/0029337 | A1 | 2/2005 | Van Handel |
| 2005/0184074 | A1 | 8/2005 | Simmons et al. |
| 2007/0000931 | A1 | 1/2007 | Hartjes et al. |
| 2007/0029332 | A1 | 2/2007 | Hartjes et al. |
| 2007/0114271 | A1 | 5/2007 | Van Handel |
| 2007/0240811 | A1 | 10/2007 | Baggot et al. |
| 2008/0093434 | A1 | 4/2008 | Van Handel |
| 2010/0224529 | A1 | 9/2010 | Forloni |
| 2010/0224637 | A1 | 9/2010 | Ikeda et al. |
| 2011/0031305 | A1 | 2/2011 | Pounder et al. |

FOREIGN PATENT DOCUMENTS

| | | | |
|---|---|---|---|
| JP | 2000-177785 | A | 6/2000 |
| JP | 2006044723 | A | 2/2006 |
| JP | 2006160346 | A | 6/2006 |
| JP | 2011116411 | A | 6/2011 |
| JP | 2011116412 | A | 6/2011 |
| WO | 2007/005793 | A1 | 1/2007 |
| WO | 2012160682 | A1 | 11/2012 |

OTHER PUBLICATIONS

International Search Report for PCT/US2006/025916 mailed Nov. 3, 3006.

Clysar LE Summary of Properties, Feb. 1, 2003, three pages, http://www.logismarket.com.mx/ip/safte-food-ingredients-pelicula-multicapa-imprimible-de-baja-energia-ficha-tecnica-clysar-le-435253.pdf.

Clysar LLG Summary of Properties, Apr. 7, 2011, three pages, XP055195983, http://www.clysar.com/pdf/Clysar_LLG_PDS.pdf.

METHODS FOR MAKING PAPERBOARD BLANKS AND PAPERBOARD PRODUCTS THEREFROM

CROSS-REFERENCE TO RELATED APPLICATIONS

This application is a continuation-in-part (CIP) of co-pending U.S. patent application having Ser. No. 12/909,617, filed on Oct. 21, 2010, and published as U.S. Publication No. 2011/0031305, which is a continuation-in-part of U.S. patent application having Ser. No. 12/380,314, filed on Feb. 26, 2009, and issued as U.S. Pat. No. 7,841,974, which is a divisional application of U.S. patent application having Ser. No. 11/478,075, filed on Jun. 29, 2006, and issued as U.S. Pat. No. 7,510,098, which is a continuation-in-part application of U.S. application having Ser. No. 11/174,434, filed on Jun. 30, 2005, and issued as U.S. Pat. No. 7,513,386, all of which are incorporated by reference herein.

BACKGROUND

1. Field

Embodiments described generally relate to methods for making paperboard blanks and paperboard products therefrom.

2. Description of the Related Art

Paperboard is used to make a wide variety of paperboard products, such as plates, bowls, and cups. Paper products can be insulated in a variety of ways to provide an insulated product, such as an insulated cup for hot or cold beverages. For example, the paper product can be insulated by forming an air gap within a sidewall of the product. The air gap, for example, can be located between a film that forms an inner surface of the sidewall and a paperboard substrate that forms an outer surface of the sidewall. The film can be a shrinkable film that can shrink, e.g., a heat shrinkable film, to form the gap between the film and the paperboard substrate as the film shrinks. As the shrinkable film shrinks and the gap forms, air or other fluid needs to flow into the gap.

One problem encountered in making an insulated product, such as a cup, with a shrinkable film is that the air required to fill the gap needs an adequate path to flow into the gap as the gap forms. Without an adequate flow path for the air to flow between the shrinkable layer and the paperboard substrate, a vacuum can form between the shrinkable film and the paperboard substrate that prevents or reduces the amount the shrinkable film can shrink. Preventing or reducing the amount the film shrinks can decrease the insulating properties of the product.

The conventional technique used to form a flow path for air to flow into the gap as the gap forms is to punch or cut a hole, slot, or other opening into the paperboard substrate with a pin, die, punch, or other physical tool. These punched openings, however, may not produce openings through the paperboard substrate that provide a flow path capable of consistently permitting a sufficient amount of air to flow through the paperboard substrate as the shrinkable film shrinks.

There is a need, therefore, for improved methods for making paperboard blanks having an adequate path for air to flow into the gap as the shrinkable film shrinks.

SUMMARY

Paperboard blanks, paperboard products, and methods for making and using same are provided. In one aspect, a method for making a paperboard blank can include burning a paperboard substrate to form at least one aperture therethrough. The method can also include securing a film onto a first side of the paperboard substrate to produce a paperboard blank.

In one aspect, a paperboard product can include a sidewall formed from a paperboard blank and a bottom panel secured to the sidewall. The sidewall can include an inner surface comprising a film and an outer surface comprising a paperboard substrate. The paperboard substrate can have at least one aperture formed therethrough. The at least one aperture can be formed by burning a portion of the paperboard substrate.

In one aspect, a method for making a paperboard product can include burning a paperboard substrate to form at least one aperture therethrough. The method can also include securing a film onto the paperboard substrate to produce a paperboard blank and forming the paperboard blank to overlap two opposing edges of the paperboard blank to form a sidewall. The sidewall can include an inner surface comprising the film, an outer surface comprising the paperboard substrate, and a first edge adapted to be curled to form a brim curl. The method can also include securing a bottom panel to the sidewall at or adjacent a second edge of the sidewall and curling the first edge of the sidewall to form the brim curl.

DETAILED DESCRIPTION

Figure 1:
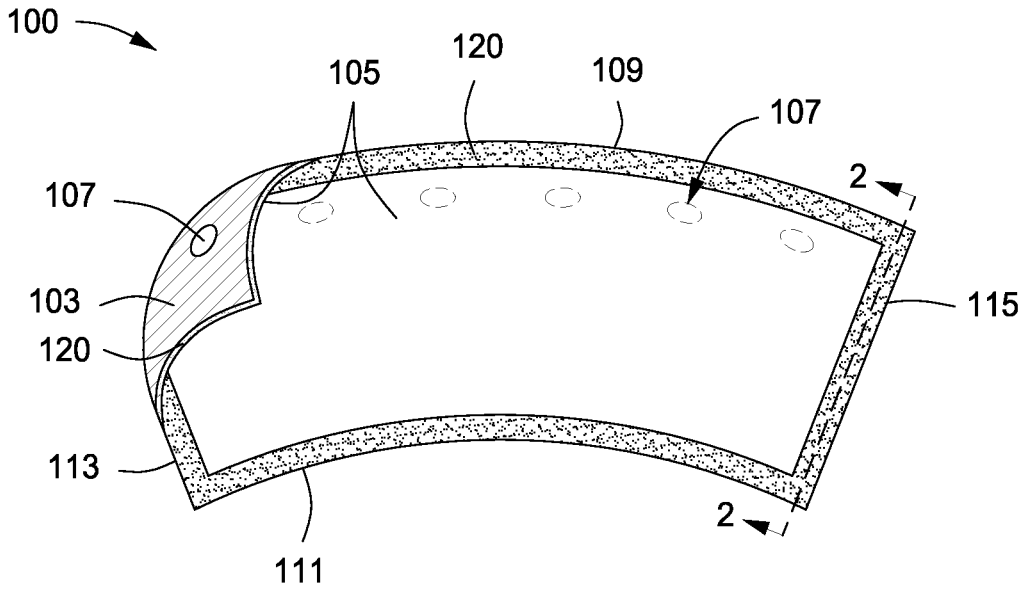
FIG. 1 depicts a schematic view of an illustrative paperboard blank, according to one or more embodiments described.
Figure 2:
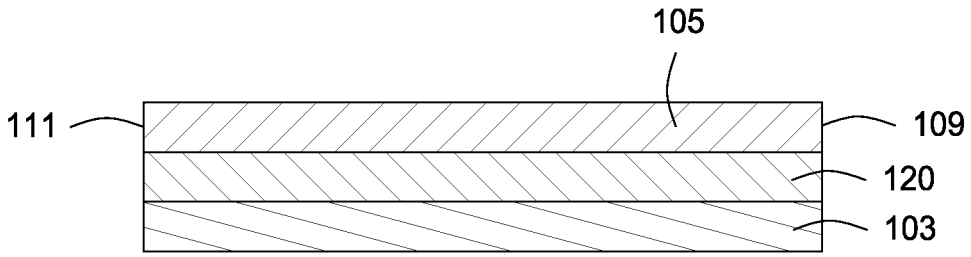
FIG. 2 depicts a schematic cross-sectional view of the paperboard blank depicted in FIG. 1 along line 2-2, according to one or more embodiments described.

FIG. 1 depicts a schematic view of an illustrative paperboard blank 100, and FIG. 2 depicts a schematic cross-sectional view along line 2-2 of the paperboard blank 100 depicted in FIG. 1. Referring to FIGS. 1 and 2, the paperboard blank 100 can include a first layer or substrate 103 and a second layer or film 105. The substrate 103 can include one or more openings, holes, or apertures 107 (six are shown) formed therethrough. The substrate 103 and the film 105 can be at least partially coupled, affixed, joined, fastened, attached, connected, or otherwise secured to one another. For example, the substrate 103 can be partially secured to the film 105 with an adhesive 120. In another example, the film 105 can be at least partially secured to the substrate 103 via heat sealing. In one or more embodiments, the film 105 can be a shrinkable film. In one or more embodiments, the substrate 103 can be a paperboard substrate. For simplicity and ease of description, embodiments provided herein will be further described with reference to a paperboard substrate 103 and a shrinkable film 105. The paperboard blank 100 can be formed into a paper product, such as a bowl, plate, container, tray, platter, deep dish container, fluted product, or cup. The terms "paper product" and "paperboard product" are intended to be interchangeable. For simplicity and ease of description, however, embodiments provided herein will be further described with reference to a paper cup.

The paperboard blank 100 can have a first or "top" edge 109, a second or "bottom" edge 111, a third or "left" edge 113, and a fourth or "right" edge 115. The particular shape of the paperboard blank 100 can depend, at least in part, on the particular container to be made from the paperboard blank 100. For example, the paperboard blank 100 depicted in FIG. 1 has arcuate first and second edges 109, 111 and straight third and fourth edges 113, 115 with the first and second edges 109, 111 opposed to one another and the third and fourth edges 113, 115 opposed to one another. The paperboard blank 100 can be formed into a paper cup having a frusto-conical outer sidewall. The third and fourth edges 113, 115 can be overlapped with one another to form a sidewall 305 having a seam 310, the first edge 109 can be curled to form a brim 315, and a bottom panel 320 (see FIGS. 3 and 4) can be secured to the sidewall at or adjacent to the second edge 111.

The adhesive 120 can be disposed between the paperboard substrate 103 and the shrinkable film 105 in any pattern or configuration. For example, the shrinkable film 105 can be secured to the paperboard substrate 103 about at least a portion of an area or region along a perimeter of the shrinkable film 105 and the paperboard substrate 103 with the adhesive 120. At least a portion of the interior or inner region between the shrinkable film 105 and the paperboard substrate 103 can be free or substantially free from the adhesive 120 such that the shrinkable film 105 can be free to move away from the paperboard substrate 103 as the shrinkable film 105 shrinks. For example, the adhesive 120 can be disposed between the shrinkable film 105 and the paperboard substrate 103 in a criss-cross or other overlapping pattern, as one or more dots or spots, in one or more lines at least partially running between the first and second edges 109, 111, in one or more lines at least partially running between the third and fourth edges 113, 115, in one or more lines at least partially running diagonally between the first and second edges 109, 111 or the third and fourth edges 113, 115, any other pattern or configuration, or any combination of patterns or configurations that provides at least some area or region between the shrinkable film 105 and the paperboard substrate 103 free or substantially free from any adhesive 120.

The adhesive 120 can be applied onto the paperboard substrate 103 and/or the shrinkable film 105 by any suitable means known in the art. For example, spraying, brushing, flexographic printing of the adhesive 120 or any other suitable coating method can be employed. Suitable patterns or configurations that the adhesive 120 can be disposed between the shrinkable film 105 and the paperboard substrate 103 and methods for applying the adhesive 120 to the shrinkable film 105 and/or the paperboard substrate 103 can also include those discussed and described in U.S. Pat. Nos. 6,536,657; 6,729,534; 7,464,856; 7,614,993; 7,600,669; 7,464,857; 7,913,873; 7,938,313; 7,513,386; 7,510,098; and 7,841,974 and U.S. Patent Application Publication No. 2011/0031305.

As shown in FIG. 1, the adhesive 120 can be disposed between the shrinkable film 105 and the paperboard substrate 103 along the perimeter of the paperboard blank 100. As such, the adhesive 120 can be disposed between the first layer 103 and the second layer 105 along at least a portion of the first edge 109 that can be curled to form the brim of the paper product (see, e.g., the brim 315 of the paper product depicted in FIGS. 3 and 4). The width of the adhesive line or "glue line" disposed between the shrinkable film 105 and the paperboard substrate 103 can be from a low of about 1 mm, about 2 mm, or about 3 mm to a high of about 4 mm, about 5 mm, 8 mm, about 10 mm, about 15 mm, about 20 mm, about 25 mm, or about 30 mm.

The second layer or shrinkable film 105 can shrink when subjected to one or more predetermined triggers or conditions. For example, the shrinkable film 105 can be a heat shrinkable film, i.e., a film that shrinks when heated to a sufficient temperature. For example, the shrinkable film 105 can shrink when heated to a temperature of about 40° C. or more, about 50° C. or more, about 60° C. or more, about 70° C. or more, about 80° C. or more, about 90° C. or more, or about 100° C. or more. In at least one example, the film 105 can shrink when exposed to a hot liquid. In at least one other example, the film 105 can shrink when heated in an oven, by contact with a flow of heated gas, or other heating means. In at least one other example, the film 105 can be shrunk by exposing the film to infrared light, microwaves, or a combination thereof.

As the shrinkable film 105 shrinks, a gap 404 (see FIG. 4 discussed and described in more detail below) can be formed between the non-secured portions of the shrinkable film 105 and the paperboard substrate 103. The gap 404 can provide an insulating property to a paperboard product, e.g., the paper cup 300 depicted in FIG. 3 and discussed and described in more detail below. For example, a heated liquid, e.g., water, having a temperature from a low of about 70° C., about 75° C., or about 80° C. to a high of about 90° C., about 95° C., about 100° C., or about 110° C. or more can be added to the paper product to cause the shrinkable film 105 to shrink and form the insulating gap 404. The formation or presence of the gap 404 can provide an outer surface of the paper product insulated from the hot liquid therein. The temperature of the outer surface of the paper product can be less than about 70° C., less than about 65° C., less than about 60° C., less than about 55° C., less than about 50° C., less than about 45° C., less than about 40° C., or less than about 35° C., when a container volume of the paperboard product is about 90% or more occupied with a liquid, e.g., water, at a temperature of 95° C. or 100° C. or more. In at least one specific example, the temperature of the outer surface of the paper product can be less than about 50° C., less than about 47° C., less than about 45° C., less than about 43° C., less than about 40° C., less than about 37° C., or less than about 35° C., when water at a temperature of about 85° C. to about 90° C. is contained within an inner or container volume of the paper product. As such, a person can hold the paper product containing the heated liquid therein about the outer surface of the product without being burned or otherwise experiencing an unsatisfactory level of discomfort due to the heated liquid within the paper product.

The one or more holes, openings, or apertures 107 can provide a flow path for air or other fluid to flow from a location external the paperboard substrate 103, through the paperboard substrate 103, and into the gap 404 as the gap forms. The one or more holes, openings, or apertures 107 can also be referred to as a vent or an inlet for air or other fluid to flow through. The one or more holes, openings, or apertures 107 can be formed through the paperboard substrate 103 by burning the paperboard substrate 103. Said another way, the paperboard substrate can be burned to form at least one aperture 107 therethrough. For example, the paperboard substrate 103 can be burned with a laser beam to form the one or more apertures therethrough. The laser beam can have an energy output sufficient to burn, thermally decompose, or otherwise remove the portion of the paperboard substrate 103 contacted with the laser to form the aperture 107. In another example, the aperture 107 can be formed through the paperboard substrate 103 by burning the paperboard substrate with a plasma, an arc, a flame, or any other suitable method. Burning the paperboard substrate 103 can completely remove a portion of the substrate to form the at least one aperture 107 therethrough.

As the shrinkable film 105 shrinks, the gap 404 can be filled with air or other fluid that can flow into the gap 404 through the one or more apertures 107. It has been surprisingly and unexpectedly discovered that forming the one or more apertures through the paperboard substrate 103 by contacting the paperboard substrate 103 with the laser beam can produce a paperboard blank 100 that can be formed into a paperboard product, e.g., the paper cups 300 and 400 in FIGS. 3 and 4, in which the shrinkable film 105 can more consistently and reliably shrink, as compared to paper cups having openings formed by a physical apparatus. For example, forming an aperture or hole with a physical apparatus such as a pin, a knife blade, or other solid object does not remove or only removes a small portion of the paperboard substrate. As such, the opening formed via a physical apparatus can re-close or at least partially re-close by the paperboard substrate 103 itself moving back into the space of the aperture. Since the laser beam can completely remove the portion of the paperboard substrate 103 that occupied the volume or space of the paperboard substrate where the aperture 107 is formed therethrough, the aperture 107 is not subject to re-closing or partially re-closing by the paperboard substrate 103, which can provide a more consistent and reliable paperboard product.

The shape or cross-sectional configuration of the laser beam can be controlled to produce an aperture 107 having any desired cross-sectional area. For example, the shape or cross-sectional configuration of the laser beam can be controlled to produce an aperture 107 having a cross-sectional area from a low of about 0.005 $mm^2$, about 0.008 $mm^2$, about 0.01 $mm^2$, 0.02 $mm^2$, about 0.04 $mm^2$, about 0.06 $mm^2$, about 0.08 $mm^2$, or about 0.1 $mm^2$, to a high of about 0.12 $mm^2$, about 0.14 $mm^2$, about 0.16 $mm^2$, about 0.18 $mm^2$, or about 0.2 $mm^2$, about 0.3 $mm^2$, about 0.4 $mm^2$, about 0.5 $mm^2$, about 0.6 $mm^2$, about 0.7 $mm^2$, about 0.8 $mm^2$, about 0.9 $mm^2$, or about 1 $mm^2$. For example, the aperture 107 can have a cross-sectional area of about 0.005 $mm^2$ to about 1 $mm^2$, about 0.02 $mm^2$ to about 1 $mm^2$, about 0.01 $mm^2$ to about 0.05 $mm^2$, about 0.02 $mm^2$ to about 0.1 $mm^2$, about 0.05 $mm^2$ to about 0.2 $mm^2$, about 0.009 $mm^2$ to about 0.07 $mm^2$, or about 0.02 $mm^2$ to about 0.04 $mm^2$. Alternatively or in addition to controlling the cross-sectional configuration of the laser beam, the laser beam can be moved about the paperboard substrate to produce the aperture 107 having any desired cross-sectional area.

The cross-sectional length of the aperture 107 can be from a low of about 0.1 mm, about 0.12 mm, about 0.14 mm, about 0.16 mm, or about 0.18 mm to a high of about 0.3 mm, about 0.4 mm, about 0.5 mm, about 0.6 mm, about 0.7 mm, about 0.8 mm, about 0.9 mm, or about 1 mm. For example, the aperture 107 can have a cross-sectional length of about 0.1 mm to about 0.5 mm, about 0.17 mm to about 0.23 mm, about 0.13 mm to about 0.47 mm, about 0.2 mm to about 0.55 mm, about 0.1 mm to about 0.3 mm, or about 0.15 mm to about 0.25 mm. In another example, the aperture 107 can have a cross-sectional length of about 0.1 mm to about 0.9 mm, about 0.3 mm to about 0.8 mm, about 0.25 mm to about 0.75 mm, about 0.3 mm to about 0.6 mm, or about 0.15 mm to about 0.35 mm. In at least one example, the cross-sectional length of the aperture 107 can be greater than a pinhole and less than 1.27 mm, preferably greater than a pinhole and less than about 1 mm.

Any number of apertures 107 can be formed through the paperboard substrate. For example, the number of apertures 107 formed through the paperboard substrate 103 can be from a low of about 1, about 2, about 3, about 4, or about 5 to a high of about 8, about 10, about 15, about 20, about 25, about 30, about 40, or about 50, or more. In another example, the number of apertures 107 formed through the paperboard substrate 103 can be about 1, about 2, about 2, about 4, about 5, about 6, about 7, about 8, about 9, about 10, about 11, about 12, about 13, about 14, or about 15.

If a paperboard substrate 103 has two or more apertures 107 formed therethrough, the two or more apertures 107 can be located in any pattern, frequency, or layout on the paperboard substrate 103 with respect to one another. For example, as shown in FIG. 1, the six apertures 107 formed through the paperboard substrate 107 can be located generally an equal distance from one another, toward or closer to the first edge 109 than the second edge 111, and in a generally equal distance from the first edge 109.

The one or more apertures 107 can provide a total or combined amount of cross-sectional area open for air or other fluid to flow from one side of the paperboard substrate 103 to the other from a low of about 0.03 $mm^2$, about 0.05 $mm^2$, about 0.1 $mm^2$, about 0.2 $mm^2$, or about 0.25 $mm^2$ to a high of about 0.3 $mm^2$, about 0.5 $mm^2$, about 1 $mm^2$, about 1.5 $mm^2$, or about 2 $mm^2$ per 480 $cm^2$ of paperboard substrate 103. For example, the total or combined amount of area formed by the apertures 107 through the paperboard substrate 103 can be from about 0.03 $mm^2$ to about 0.3 $mm^2$, about 0.1 mm to about 0.2 $mm^2$, about 0.06 $mm^2$ to about 0.5 $mm^2$, about 0.4 $mm^2$ to about 0.9 $mm^2$, or about 0.5 $mm^2$ to about 0.85 $mm^2$ per 480 $cm^2$ of paperboard substrate 103.

The contour or outer perimeter of the aperture 107 can be any desired geometric configuration or shape. Said another way, the perimeter, periphery, or circumference of the paperboard substrate 103 that defines the aperture 107 can be any desired shape. Illustrative geometric shapes can be or include, but are not limited to, a circle, triangle, rectangle, pentagon, hexagon, octagon, ellipse, oval, and the like, or any combination thereof. Said another way, a perimeter of the paperboard substrate 103 that defines the aperture 107 can be circular, triangular, rectangular, pentagonal, hexagonal, octagonal, elliptical, oval, and the like. In at least one example, the aperture 107 can have a circular shape. In at least one other example, the aperture 107 can have an elliptical shape. In at least one other example, the aperture 107 can have an oval shape. The shape of the aperture 107 can be used to help achieve a particular aesthetic look and/or of feel of the paperboard substrate 103, to obscure or "camouflage" the presence of the aperture 107. In another example, the geometric shape can be the most convenient or efficient shape for forming with the laser beam.

About 100 $cm^3$ of air or other gaseous fluid can flow from a location external to the paperboard substrate 103, through a single aperture 107, and into the gap 404 as the gap 404 forms in a time of about 60 seconds or less, about 50 seconds or less, about 40 seconds or less, about 30 seconds or less, about 25 seconds or less, about 20 seconds or less, about 15 seconds or less, about 10 seconds or less, about 5 seconds or less, about 3 seconds or less, about 2 seconds or less, about 1 second or less, or about 0.5 seconds or less. For example, about 100 $cm^3$ of air or other gaseous fluid can flow from a location external the paperboard substrate 103, through the aperture 107, and into the gap 404 as the gap 404 forms in a time of about 15 seconds to about 40 seconds, about 20 seconds to about 35 seconds, about 25 seconds to about 32 seconds, or about 27 seconds to about 30 seconds.

The number of apertures 107 formed through the paperboard substrate 103 can be sufficient to permit about 100 $cm^3$ of air or other gaseous fluid to flow through the paperboard substrate 103 via the aperture 107 and into the gap 404 as the gap 404 forms in a time of about 15 seconds or less, about 10 seconds or less, about 5 seconds or less, about 3 seconds or less, about 2 seconds or less, about 1 second or less, or about 0.5 seconds or less. The number of apertures 107 formed through the paperboard substrate 103 can be sufficient to permit about 100 $cm^3$ of air or other gaseous fluid to flow through the paperboard substrate 103 via the aperture 107 and into the gap 404 as the gap 404 forms in a time of about 0.1 seconds to about 15 seconds, about 1 second to about 12 seconds, about 3 seconds to about 10 seconds, about 5 seconds to about 10 seconds, or about 6 seconds to about 8 seconds. In at least one specific example, a plurality of about 4 laser holes can permit about 100 $cm^3$ of air or other gaseous fluid to flow through the paperboard substrate 103 via the apertures 107 and into the gap 404 as the gap 404 forms in a time of about 0.1 seconds to about 15 seconds, about 1 second to about 12 seconds, about 3 seconds to about 10 seconds, about 5 seconds to about 10 seconds, or about 6 seconds to about 8 seconds.

Illustrative lasers suitable for producing the laser beam for forming the one or more apertures 107 can include, but are not limited to, gas lasers, chemical lasers, excimer lasers, solid-state lasers, and semiconductor lasers. In at least one example, the laser used to produce the laser beam for burning the paperboard substrate 103 to form the one or more apertures 107 therethrough can be a Preco model FLG200, which is a 200 W sealed carbon dioxide laser that emits a 10.6 μm wavelength laser beam.

The paperboard substrate 103 can be or include any paperboard material capable of forming a desired paper product. It should be noted that the paperboard substrate 103 can be or include non-paperboard or non-paper based materials such as one or more polymers, e.g., polyolefins, and/or metals, e.g., aluminum. Paperboard materials suitable for use as the paperboard substrate 103 can have a basis weight of about 163 grams to about 550 grams per square meter (about 100 pounds to about 339 pounds per 3,000 square feet) of paperboard substrate or about 195 grams to about 500 grams per square meter (about 120 pounds to about 306 pounds per 3,000 $ft^2$) of paperboard substrate. The basis weight of the paperboard material can be from a low of about 195 grams, about 210 grams, about 225 grams, about 250 grams, or about 275 grams to a high of about 325 grams, about 350 grams, about 375 grams, about 400 grams, about 425 grams, or about 450 grams per square meter of paperboard substrate. The paperboard material can have a thickness from a low of about 175 μm, about 200 μm, about 225 μm, or about 250 μm to a high of about 350 μm, about 400 μm, about 450 μm, about 500 μm, about 550 μm, or about 600 μm. In another example, the paperboard material can have a thickness of about 185 μm to about 475 μm, about 215 μm to about 425 μm, or about 235 μm to about 375 μm.

If the paperboard substrate 103 is or includes paperboard, the paperboard can be coated or uncoated with one or more additional materials. For example, the paperboard can be uncoated, e.g., free from wax, clay, polyethylene, and other coating material. In another example, a suitable paperboard can be or include paperboard coated with one or more waxes, one or more clays, and/or one or more polyolefins on one or both sides. A paperboard can be coated with polyethylene, for example, using any suitable process. In one example, a polyethylene coating can be applied to the paperboard via an extrusion process. Polyethylene and/or other polymeric materials can be coated onto the paperboard to provide liquid resistance properties and/or serve as a heat sealable coating. Suitable polymeric materials that can be used to coat the paperboard can include, but are not limited to, polyethylene, polypropylene, polyester, or any combination thereof. If the paperboard 103 is coated with a material, e.g., wax or polymeric material, the coating can have a thickness from a low of about 0.002 mm, about 0.005 mm, about 0.01 mm, about 0.03 mm, about 0.05 mm, about 0.07 mm, or about 0.1 mm to a high of about 0.15 mm, about 0.17 mm, about 0.2 mm, about 0.25 mm, about 0.3 mm, or about 0.35 mm.

Commercially available paperboard material that can be used as the paperboard substrate 103 can include, but is not limited to, solid bleached sulfate (SBS) cupstock, bleached virgin board, unbleached virgin board, recycled bleached board, recycled unbleached board, or any combination thereof. For example, SBS cupstock available from Georgia-Pacific Corporation can be used as the second layer 103.

The shrinkable film 105 can be uniaxially or biaxially oriented. In at least one specific example, the shrinkable film 103 can be a biaxially oriented, heat shrinkable polymeric film. In at least one specific example, the shrinkable film 105 can be a uniaxially oriented, heat shrinkable polymeric film. The shrinkable film 105 can be a mono-layer film or a multi-layer film. Orientation in the direction of extrusion is known as machine direction (MD) orientation. Orientation perpendicular to the direction of extrusion is known as transverse direction (TD) orientation. Orientation can be accomplished by stretching or pulling a film first in the MD followed by TD orientation. Blown films or cast films can also be oriented by a tenter-frame orientation subsequent to the film extrusion process, again in one or both directions. Orientation can be sequential or simultaneous, depending upon the desired film features. Typical commercial orientation processes are BOPP (biaxially oriented polypropylene) tenter process, blown film, and LISIM technology.

The total thickness of the resulting monolayer and/or multilayer shrinkable film 105 can vary. A total film thickness of about 5 μm to about 50 μm or about 10 μm to about 30 μm can be suitable for most paperboard products. The shrinkable film 105 can have any desired thickness. Preferably the thickness of the shrinkable film 105 can be sufficient to reduce or prevent the shrinkable film 105 from breaking, tearing, ripping, or otherwise forming holes therethrough. The shrinkable film 105 can have a thickness from a low of about 5 μm, about 10 μm, or about 15 μm to a high of about 20 μm, about 25 μm, about 30 μm, or about 35 μm. For example, the shrinkable film 103 can have a thickness of about 11.43 μm, about 12.7 μm, about 15.24 μm, or about 19.05 μm.

A surface area of the shrinkable film 105 can shrink or reduce from an original or starting surface area to a second or final surface area in an amount of about 5%, about 10%, about 15%, about 20%, about 25%, about 30%, about 35%, about 40%, about 45%, about 50%, about 55%, or about 60% based on the original or starting surface area. For example, a heat shrink film having a surface area of about 100 $cm^2$ can be reduced to about 95 $cm^2$, about 90 $cm^2$, about 85 $cm^2$, about 80 $cm^2$, about 75 $cm^2$, about 70 $cm^2$, about 65 $cm^2$, about 60 $cm^2$, about 55 $cm^2$, about 50 $cm^2$, about 45 $cm^2$, or about 40 $cm^2$ when subjected to a temperature of about 40° C. to about 100° C. In at least one specific example, the surface area of the shrinkable film 105 can shrink in an amount of about 40%, about 45%, about 50%, about 55%, or about 60% when heated to a temperature of 102° C. for a time of 10 minutes. The shrinkage of the shrinkable film 105 can be measured according to ASTM D1204.

Commercially available films that can be used as the shrinkable film 105 can include, but are not limited to, Clysar® HPG (HP Gold), Clysar® LLGT, Clysar® VEZT, Clysar® LLG, Clysar® ABL, available from Bemis Clysar, Oshkosh, Wis. In one or more embodiments, the second layer or film 105 can be a non-shrinkable film. A non-shrinkable film can be made from one or more polymeric materials that do not shrink when heated to a temperature up to about 100° C. Illustrative materials that can be used to make a non-shrinkable film can include, but are not limited to, one or more polyethylenes, one or more polypropylenes, one or more polyesters, and the like.

The adhesive 120 can be a single or one part adhesive or glue. As used herein, the terms "single part" and "one part," when used in conjunction with "adhesive" or "glue," refer to an adhesive or an adhesive system that does not require the addition of a hardener, catalyst, accelerant, or other cure component or agent required to make the adhesive curable. Said another way, the adhesive 120 can include two or more different components, but the adhesive can be of a type that does not require adding a second component to the adhesive to form a curable adhesive. As such, the adhesive 120 can be storage stable for weeks, months, or even years and upon application of the adhesive 120 to the paperboard substrate 103 and/or the shrinkable film 105, the adhesive 120 can be cured without the need for a hardener, catalyst, accelerator, or other cure agent. The adhesive 120 can be or include a polyethylene vinyl acetate resin. The adhesive 120 can include one or more additives. Illustrative additives can include, but are not limited to, one or more tackifiers. Suitable tackifiers can include, but are not limited to, ethyl p-toluene sulfonamide. The amount of the additive, e.g., the tackifier, if present, can range from a low of about 1 wt %, about 3 wt %, or about 5 wt % to a high of about 8 wt %, about 10 wt %, about 12 wt %, or about 15 wt %, based on the total weight of the adhesive.

The adhesive 120 can be a multi-part adhesive or glue. For example, the adhesive 120 can be a two-part adhesive system, with the first component an adhesive and the second component a hardener, catalyst, accelerant, or other cure component or agent to make the adhesive curable. A suitable two-part adhesive can include poly ethyl acrylate as the adhesive and diisocyanatohexane homopolymer as the curing agent.

Commercially available adhesives suitable for use as the adhesive 120 discussed and described above and elsewhere herein can include, but are not limited to, Velocity® 33-9192 and Velocity® 33-9080, a two-part adhesive system that includes a poly ethyl acrylate adhesive (38-063A) and a diisocyanatohexane homopolymer curing agent (38-060A), all available from Henkel Corporation. It is believed that the Velocity® 33-9192 and Velocity® 33-9080 adhesives are both polyethylene vinyl acetate resins, with the Velocity® 33-9192 including the addition of ethyl p-toluene sulfonamide (tackifier) in an amount of about 5 wt % to about 10 wt %, based on the total weight of the adhesive.

In one or more embodiments, at least a portion of the surface(s) of the paperboard substrate 103 and/or the shrinkable film 105 can be oxidized via corona and/or flame discharge treatment. Oxidizing the surface of the paperboard substrate 103 and/or the shrinkable film 105 can increase or raise the surface energy of the treated surface. The shrinkable film 105 can have a surface energy, treated or untreated, greater than about 30 dyne/cm, greater than about 35 dyne/cm, greater than about 38 dyne/cm, greater than about 40 dyne/cm, greater than about 42 dyne/cm, greater than about 44 dyne/cm, or greater than about 46 dyne/cm.

The method for making the paperboard blank 100 can include contacting the paperboard substrate 103 with a laser beam to form at least one aperture therethrough. The method can also include securing the shrinkable film 105 onto a first side of the paperboard substrate 103 to produce the paperboard blank 100. The shrinkable film 105 can be at least partially secured to the paperboard substrate 103 with the adhesive 120, by heat sealing, or a combination thereof. The adhesive 120, if present, can be applied by any suitable means known in the art. For example, spraying, brushing, flexographic printing of the adhesive 120 or any other suitable coating method can be employed.

The paperboard blank 100 can be formed as part of a paperboard roll (not shown) that includes a plurality of paperboard blanks 100 formed therein. The paperboard blank 100 can be cut from the paperboard roll. A paperboard roll can be formed that includes any number of paperboard blanks 100 formed therein. The one or more apertures 107 can be formed into a plurality of paperboard blanks 100 that are in a paperboard roll and/or after the plurality of paperboard blanks 100 are cut or otherwise removed from the paperboard roll.

Figure 3:
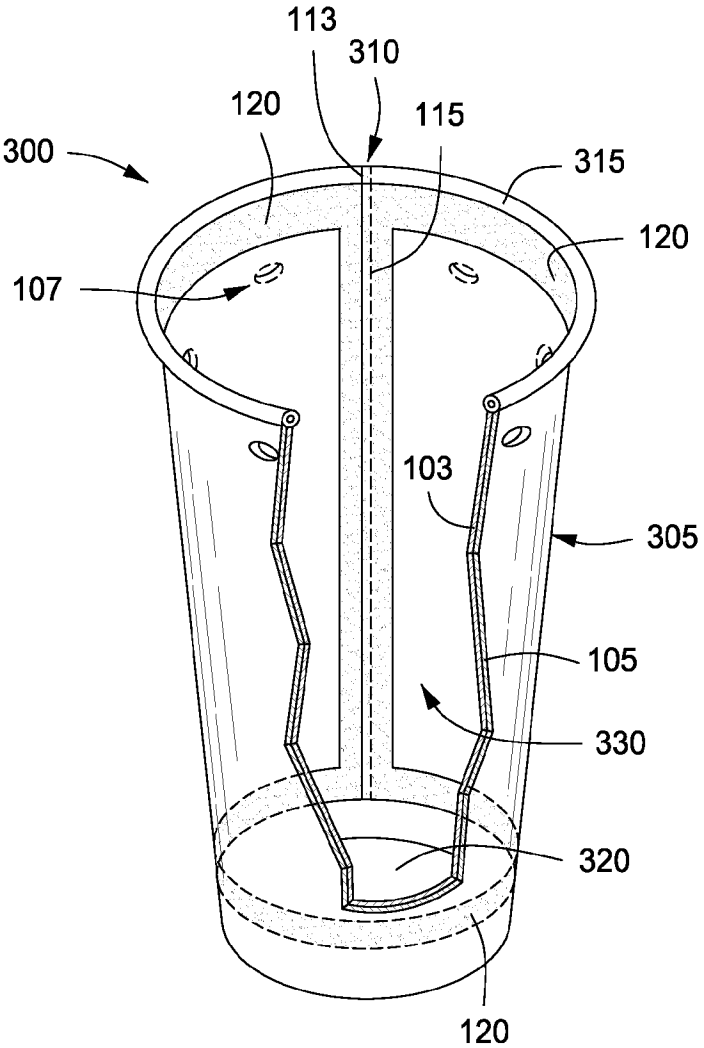
FIG. 3 depicts a partial cut away, perspective view of an illustrative paper cup, according to one or more embodiments described.

FIG. 3 depicts a partial cut away perspective view of a paper cup 300, according to one or more embodiments. The paper cup 300 can include a sidewall 305, a bottom panel or cup bottom 320, and a brim curl 315. The sidewall 305 can include the paperboard substrate 103 and the shrinkable film 105. The shrinkable film 105 can form or provide at least a portion of the inner surface of the sidewall 305 and the paperboard substrate 103 can form or provide at least a portion of the outer surface of the sidewall 305. As shown in FIG. 3, the shrinkable film 105 has not been shrunk to provide a shrunk film 105.

The sidewall 305 can be formed by rolling or otherwise placing the third and fourth edges 113, 115 of the paperboard blank 100 depicted in FIG. 1 in contact with one another to form the seam 310. For example, the paperboard blank 100 can be formed around a mandrel to form the seam 310. As such, the first edge 109 can form a first or "top" edge of the sidewall 305 and the second edge 111 can form a second or "bottom" edge of the sidewall 305. If the paperboard substrate 103 is coated with a polymeric material, e.g., polyethylene, the sidewall 305 can be heat sealed to provide a sealed seam 310. The seam 310 can also be sealed with one or more adhesives, e.g., the adhesive 120 or any other adhesive suitable for sealing the third and fourth edges 113, 115 to one another. As shown, the adhesive 120 can be used to secure the shrinkable film 105 to the paperboard substrate 103 along the third and fourth edges 113, 115 and, as such, can be present within the seam 310.

The brim curl 315 can be formed by rolling, folding, curling, or otherwise urging the first or top edge of the sidewall 305 upon itself. The brim curl 315 can be formed by urging the first edge of the sidewall 305 toward the paperboard substrate 103.

The second edge 111 of the paperboard blank 100 can form a second or "bottom" edge of the sidewall 305. The bottom panel 320 of the paper cup 300 can be disposed on or otherwise secured to the sidewall 305, e.g., proximate or adjacent the second edge of the sidewall, such that the sidewall 305 and the bottom panel 320 define a product volume 330. The bottom panel 320 can be coupled, affixed, joined, fastened, attached, connected, or otherwise secured to the sidewall 305 with the adhesive 120, another adhesive, and/or via other means such as by heat sealing. For example, similar to the paperboard substrate 103, the bottom panel 320 can be coated in a polymeric material capable of forming a seal between the polymeric material, if present, on the paperboard substrate 103.

The outer and/or inner surface of the sidewall 305 can include one or more printed patterns that can be applied to the paperboard substrate 103. "Printed patterns" and like terminology can refer to ink-printed patterns for aesthetics. Such features, however, can have a functional aspect such as indicating a fill line.

The paper cup 300 can have any suitable volume 330. For example, the volume 330 can range from a low of about 20 mL, about 40 mL, about 60 mL, about 80 mL, or about 100 mL to a high of about 120 mL, about 200 mL, about 300 mL, about 400 mL, about 500 mL, about 750 mL, about 1,000 mL, about 1,300 mL, or about 1,500 mL. For example, the volume 595 can be from about 150 mL to about 500 mL, about 450 mL to about 1,000 mL, about 400 mL to about 900 mL, or about 800 mL to about 1,300 mL.

The time required for the shrinkable film 105 to shrink or transition between an initial state to a shrunk state can vary based on one or more factors such as the area of the shrinkable film, the thickness of the shrinkable film, the temperature of the hot fluid placed into contact or otherwise in a heat exchanging relationship with the shrinkable film 105, or combinations of these and/or other factors. In the initial state, the shrinkable film 105 can be free from any prior shrinking or the film 105 can be partially or pre-shrunk, but not fully shrunk. Typically the amount to time required for the shrinkable film 105 to go from the non-shrunk state to the shrunk state can be about 10 seconds or less, about 9 seconds or less, about 8 seconds or less, about 7 seconds or less, about 6 seconds or less, about 5 seconds or less, about 4 seconds or less, about 3 seconds or less, about 2 seconds or less, about 1 second or less, or about 0.5 seconds or less per 100 mL of volume 330, when a fluid at a temperature of about 70° C. to about 100° C. contacts the shrinkable film 105. For example, the shrinkable film 105 can transition from the non-shrunk state to the shrunk state in a time of about 0.5 seconds to 2 seconds per 100 mL of volume 330, when a fluid at a temperature of about 80° C. to about 100° C. contacts the shrinkable film 105. For example, if the volume is about 600 mL the shrinkable film 105 can transition from the non-shrunk state to the shrunk state in about 3 seconds to about 12 seconds when a fluid at a temperature of about 90° C. contacts the shrinkable film 105.

After forming the paperboard product, e.g., the paper cup 300, the shrinkable film 103 can optionally be shrunk at the site of manufacture to provide paperboard products having the shrinkable film 103 already shrunk. Said another way, paperboard products can be manufactured and sold or otherwise distributed with the film 103 already having been transitioned to the shrunk state.

Figure 4:
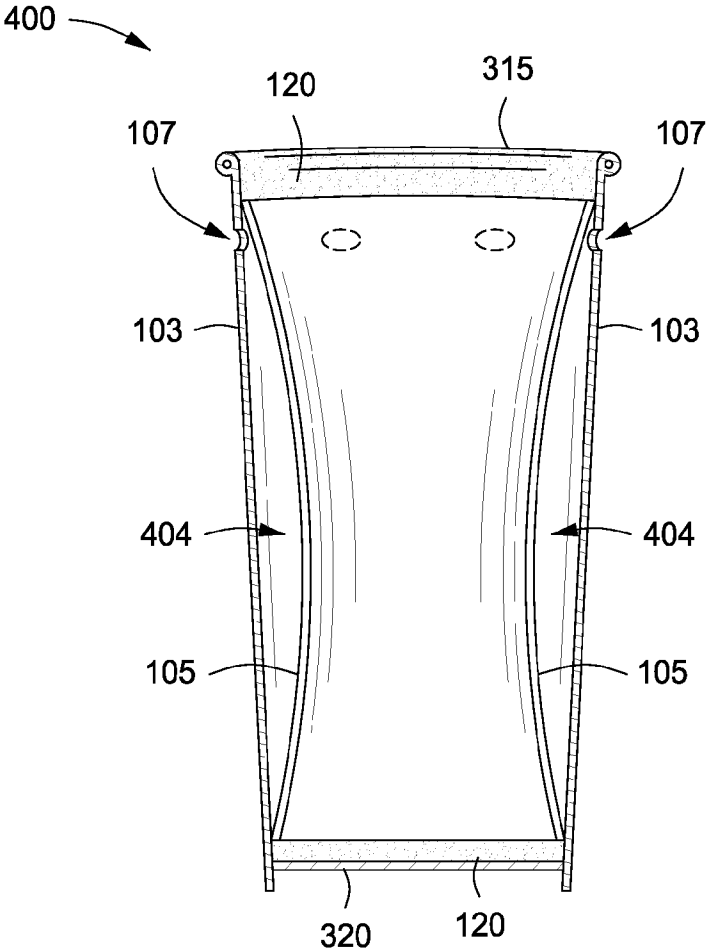
FIG. 4 depicts a cross-sectional, elevation view of a paper cup having a brim curl, a shrunk film, and a gap formed or located between the shrunk film and a paperboard substrate, according to one or more embodiments described.

FIG. 4 depicts a cross-sectional elevation view of a paper cup 400 having a brim curl 315, a shrunk film 105, and a gap 404 formed or located between the shrunk film 105 and the paperboard substrate 103, according to one or more embodiments. As the shrinkable film 105 shrinks, the amount of liquid the paperboard product can hold can be reduced. As shown in FIG. 4, the gap 404 can occupy a space or volume within the paper cup 400 that does not contain any liquid. For example, the volume 330 can be reduced by about 35% or less, about 30% or less, about 25% or less, about 20% or less, about 15% or less, about 10% or less, or about 5% or less with the shrinkable film 105 shrunk and the gap formed 404 as compared to the volume 330 before the shrinkable film 105 shrinks.

EXAMPLES

In order to provide a better understanding of the foregoing discussion, the following non-limiting examples are offered. Although the examples may be directed to specific embodiments, they are not to be viewed as limiting the invention in any specific respect. All parts, proportions, and percentages are by weight unless otherwise indicated.

Comparative paper cups (C1, C2, C3, and C4) and two inventive paper cups (Ex. 1 and Ex. 2) each having at least one aperture formed through the paperboard substrate were made and the time required for 100 $cm^3$ of air to flow through each aperture was measured. Each paper cup was a 591.5 mL (about 20 ounces) cup and had a 60 gauge LLGT film that was purchased from Bemis Company, Inc. as the shrinkable film. The paperboard substrate for each cup was CPH190 purchased from Georgia Pacific. The 60 gauge LLGT film was secured to the paperboard substrate with 38-063A adhesive that was purchased from Henkel.

The comparative paper cups C1, C2, and C3 each had a U-shaped vent formed through the paperboard substrate as discussed and described in U.S. Patent Application Publication No. 2011/0031305. The length of the U-shaped cut to form the U-shaped vent was 3.96 mm, the width of the U-shaped vent was 3.66 mm, and the area of the U-shaped vent was 13.06 $mm^2$. The comparative paper cup C1 had six U-shaped vents and each vent was unopened, meaning the "U" shaped flap or tab portion intentionally blocked the aperture. The comparative paper cup C2 also had six U-shaped vents, but each vent was left in the "as punched" state, i.e., the "U" shaped flap or tab portion was not intentionally manipulated. The comparative paper cup C3 had a single U-shaped vent that was intentionally forced all the way open so that none of the "U" shaped flap or tab portion was located within the aperture. The comparative paper cup of C4 had a single 1.5875 mm diameter hole punched through the paperboard substrate with a punch. The inventive example (Ex. 1) had 4 elliptical holes formed through the paperboard substrate with a laser. The elliptical holes each had a length of 0.279 mm, a width of 0.178 mm, and an area of 0.156 $mm^2$. The inventive example (Ex. 2) had 8 elliptical holes formed through the paperboard substrate with a laser. The elliptical holes each had a length of 0.279 mm, a width of 0.178 mm, and an area of 0.156 $mm^2$.

The time required for 100 $cm^3$ of air to flow through each different aperture in comparative paper cups C1-C4 and the inventive paper cup Ex. 1 are shown in Table 1 below. The time required for 100 $cm^3$ to flow through the all the vents formed through the paperboard substrate in each cup is also shown in Table 1.

TABLE 1

| Example | Vent | Comment | Air Resistance per Aperture, s/100 $cm^3$ | Total Time for Cup |
|---|---|---|---|---|
| C1 | 6 - U-Vents | unopened | 5,383 +/– 941 | 897 |
| C2 | 6 - U-Vents | as punched | 191 +/– 60.2 | 31.8 |
| C3 | 1 - U-Vent | open | 0.8 +/– 0.2 | 0.8 |
| C4 | 1 - 1.5875 mm punched hole | as punched | 1.8 +/– 0.4 | 1.8 |
| Ex. 1 | 4 - 0.279 mm × 0.178 mm ellipses | completely open | 28.4 +/– 2.6 | 7.1 |
| Ex. 2 | 8 - 0.279 mm × 0.178 mm ellipses | completely open | 28.4 +/– 2.6 | 3.6 |

As shown in Table 1 the ability for air to flow through the U-shaped vents of comparative examples C1-C3 can widely vary based on the particular amount or degree the vent is open. Paper cups made with U-shaped vents do not perform consistently because the flap or tab portion of the vent can block the aperture, be pushed all the way open, or have some position between closed and fully open. In contrast the apertures formed with the laser beam performed the same for both Ex. 1 and Ex. 2.

Figure 5:
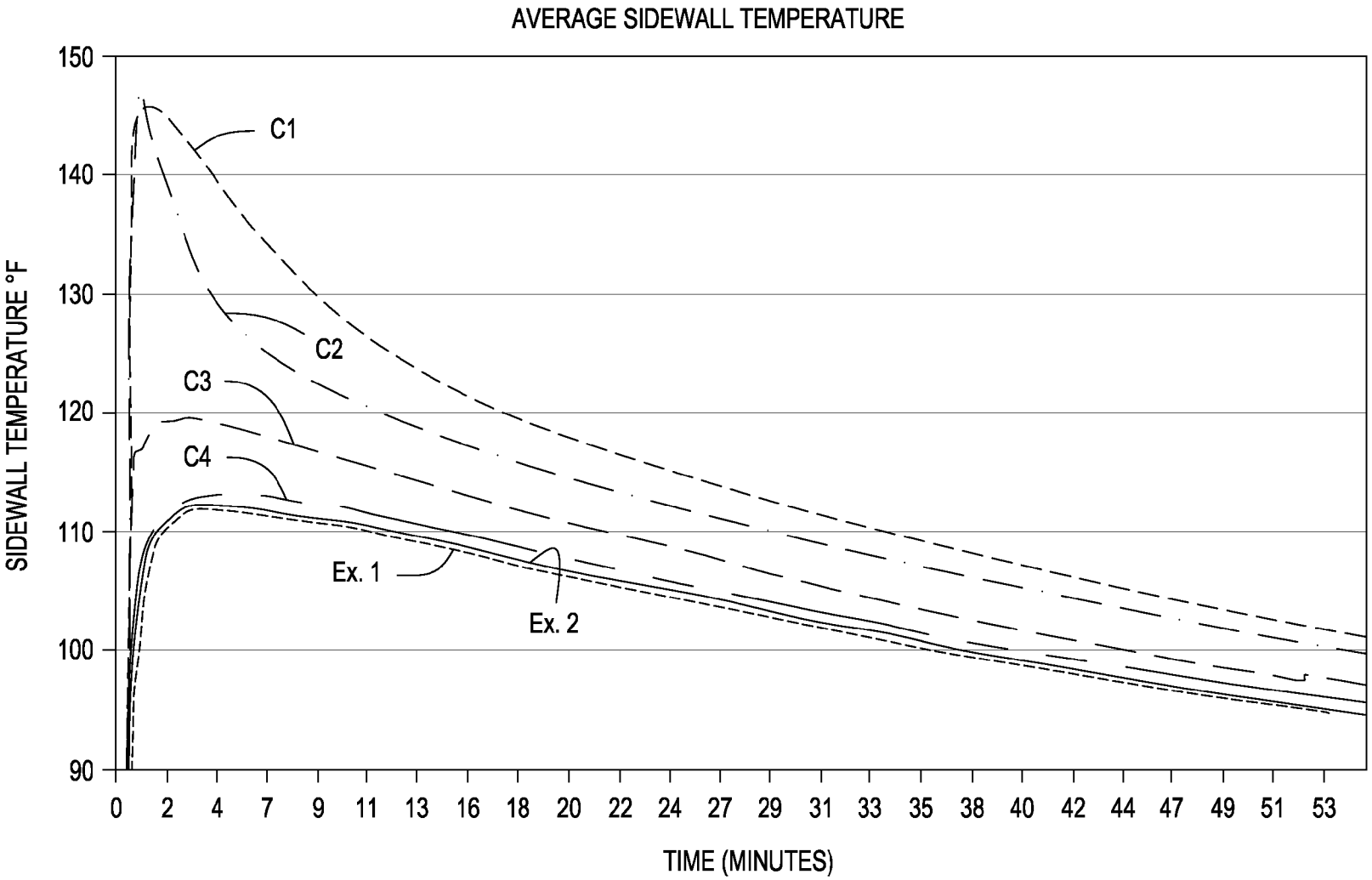
FIG. 5 depicts the average outer sidewall temperature of various paper cups containing hot water measured against elapsed time.

The average outer sidewall temperature for each paper cup (C1-C4 and Ex. 1 and 2) was also measured when heated water was poured into the paper cup. The outer sidewall temperature was measured at 9 locations and the average of those measurements was determined and is graphically depicted in FIG. 5. 591 mL of water at a temperature of 87.8° C.+/−2.8° C. was poured into each cup. The greater the increase in outer sidewall surface temperature indicates the inner shrinkable film shrank more slowly. As shown in FIG. 5, the paper cups of Ex. 1 and Ex. 2 maintained a lower sidewall temperature as compared to comparative paper cups C1-C4. The paper cup of comparative example C4 that had the 1.5875 mm diameter hole performed similar to the paper cups of Ex. 1 and Ex. 2. The maximum outer surface temperature for Ex. 1 and Ex. 2 was about 112° F. (about 44.4° C.). The comparative cups of C1 and C2 exhibited a substantial initial increase in outer sidewall temperature in excess of about 145° F. (about 62.8° C.).

Certain embodiments and features have been described using a set of numerical upper limits and a set of numerical lower limits. It should be appreciated that ranges from any lower limit to any upper limit are contemplated unless otherwise indicated. Certain lower limits, upper limits, and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present disclosure, other and further embodiments of the disclosure may be devised without departing from the basic scope thereof, and the scope thereof is determined by the claims that follow.

What is claimed is:

1. A paperboard product, comprising:
a sidewall formed from a paperboard blank; and
a bottom panel secured to the sidewall, wherein the sidewall comprises:
an inner surface comprising a film; and
an outer surface comprising a paperboard substrate, wherein the paperboard substrate has at least one aperture formed therethrough, and wherein the at least one aperture is formed by burning a portion of the paperboard substrate.

2. The paperboard product of claim 1, wherein the paperboard substrate is burned with a laser beam.

3. The paperboard product of claim 1, wherein the film is a shrinkable film.

4. The paperboard product of claim 3, wherein the shrinkable film comprises a biaxially oriented heat shrinkable polymeric material.

5. The paperboard product of claim 1, wherein the sidewall further comprises a brim formed by curling a first edge of the sidewall.

6. The paperboard product of claim 1, wherein the film is secured to the paperboard substrate with an adhesive.

7. The paperboard product of claim 1, wherein the paperboard substrate comprises at least a first outer layer, a second outer layer, and an intermediate layer, wherein the first and second outer layers comprise polyethylene, and wherein the intermediate layer comprises a paperboard.

8. The paperboard product of claim 7, wherein the film is secured to the paperboard substrate by heat sealing the film to the paperboard substrate.

9. The paperboard product of claim 1, wherein the at least one aperture has a cross-sectional area of about 0.005 $mm^2$ to about 1 $mm^2$.

10. A method for making a paperboard product, comprising:
burning a paperboard substrate to form at least one aperture therethrough;
securing a film onto the paperboard substrate to produce a paperboard blank;
forming the paperboard blank to overlap two opposing edges of the paperboard blank to form a sidewall, wherein the sidewall comprises:
an inner surface comprising the film,
an outer surface comprising the paperboard substrate, and
a first edge adapted to be curled to form a brim curl, and
securing a bottom panel to the sidewall at or adjacent a second edge of the sidewall; and
curling the first edge of the sidewall to form the brim curl.

11. The method of claim 10, wherein the paperboard substrate is burned with a laser beam.

12. The method of claim 10, wherein the film is a shrinkable film.

13. The method of claim 10, wherein the film is secured to the paperboard substrate with an adhesive.

14. The method of claim 10, wherein burning the paperboard substrate completely removes a portion of the substrate to form the at least one aperture.

15. The method of claim 10, wherein the at least one aperture has a cross-sectional area of about 0.005 $mm^2$ to about 1 $mm^2$.

16. The method of claim 10, wherein the film is a shrinkable film, and wherein the sidewall and the bottom panel define a product volume adapted to contain a liquid, the method further comprising selecting a shrinkable film in which an area of the shrinkable film decreases in an amount of about 10% to about 40% when a liquid at a temperature of up to about 100° C. is introduced into the product volume.

17. The method of claim 10, wherein the film is a shrinkable film, and wherein the sidewall and the bottom panel define a product volume adapted to contain a liquid, the method further comprising selecting a shrinkable film that will shrink when a liquid at a temperature of about 70° C. to about 100° C. is introduced into the product volume, and wherein the outer surface of the sidewall remains at a temperature of about 44° C. or less after the liquid is introduced to the product volume.

18. The method of claim 10, wherein the film is a shrinkable film, the method further comprising selecting a shrinkable film that shrinks when contacted with a fluid at a temperature of about 70° C. to about 100° C. to provide a paperboard container having a shrunk film and a gap located between at least a portion of the shrunk film and the paperboard substrate.

19. A paperboard product, comprising:
a sidewall formed from a paperboard blank; and
a bottom panel secured to the sidewall, wherein the sidewall comprises:

an inner surface comprising a shrinkable film; and an outer surface comprising at least a first outer layer, a second outer layer, and an intermediate layer, wherein the first and second outer layers comprise polyethylene, and the intermediate layer comprises a paperboard, wherein the sidewall has at least one aperture formed therethrough, and the at least one aperture is formed by burning a portion of the sidewall, and wherein the shrinkable film shrinks at a temperature of at least 70° C. to provide a gap between at least a portion of the shrunk film and the outer surface.

20. The paperboard product of claim 19, wherein the sidewall is burned with a laser beam to form the at least one aperture.

21. The paperboard product of claim 19, wherein the shrinkable film comprises a biaxially oriented heat shrinkable polymeric material.

22. The paperboard product of claim 19, wherein the sidewall further comprises a brim formed by curling a first edge of the sidewall.

23. The paperboard product of claim 19, wherein the film is secured to the outer surface of the sidewall with an adhesive.

24. The paperboard product of claim 19, wherein the film is secured to the outer surface of the sidewall by heat sealing the film to the outer surface.

25. The paperboard product of claim 19, wherein the at least one aperture has a cross-sectional area of about 0.005 $mm^2$ to about 1 $mm^2$.

26. The paperboard product of claim 19, wherein the at least one aperture is located near a top of the sidewall.

* * * * *